US010390601B2

(12) United States Patent
Mehta

(10) Patent No.: US 10,390,601 B2
(45) Date of Patent: Aug. 27, 2019

(54) SYSTEM AND METHOD FOR APPLYING COSMETICS

(71) Applicant: Je Matadi, Inc., Stafford, TX (US)

(72) Inventor: Pershant Mehta, Stafford, TX (US)

(73) Assignee: Je Matadi, Inc, Stafford, TX (US)

( * ) Notice: Subject to any disclaimer, the term of this patent is extended or adjusted under 35 U.S.C. 154(b) by 1141 days.

(21) Appl. No.: 14/147,556

(22) Filed: Jan. 5, 2014

(65) Prior Publication Data

US 2015/0189972 A1 Jul. 9, 2015

(51) Int. Cl.
*A45D 24/00* (2006.01)
*A45D 40/26* (2006.01)
(Continued)

(52) U.S. Cl.
CPC ..... *A45D 34/04* (2013.01); *A45D 44/005* (2013.01); *B05B 7/2416* (2013.01); *B05B 15/061* (2013.01)

(58) Field of Classification Search
CPC ..... B05B 7/02; B05B 7/2405; B05B 7/2408; B05B 7/2416; B05B 7/2418; B05B 7/12; B05B 7/2478; B05B 7/0441; B05B 7/1209; B05B 7/2429; B05B 7/2435; B05B 7/06; B05B 7/2491; B05B 11/06; B05B 15/061; B05B 7/2459; A45D 2007/002; A45D 2019/0066; A45D 34/04; A45D 19/02; A45D 2029/005; A45D 29/11; A45D 29/14; A45D 29/18; A45D 29/20; A45D 2200/057; A45D 2200/10; A45D 44/00; A45D 44/005; A45D 2044/007; A45C 5/005; A45C 11/008; A45C 11/24
(Continued)

(56) References Cited

U.S. PATENT DOCUMENTS 4,330,088 A * 5/1982 Koyama et al. ..... 239/318
5,088,903 A * 2/1992 Tomatsu ..... 417/473
(Continued)

OTHER PUBLICATIONS http://webarchive.org/web/20120603005506/http://www.airbasemakeup.com/airbrush-and-mini-compressor# (Jun. 3, 2012).*
(Continued)

*Primary Examiner* — Vanitha Elgart
(74) *Attorney, Agent, or Firm* — Andrew W. Chu; Craft Chu PLLC

(57) ABSTRACT

The system and method for applying cosmetics includes an integral unit formed of a lower housing, an upper housing and a cover. A compressor module is housed inside the lower housing. A control module is housed inside the upper housing, above the compressor module. The control module includes a view screen, printed circuit board connected to the compressor module, an interactive control board connected to the printed circuit board, and a speaker. There is a cosmetics applicator formed by an air hose and an airbrush stylus. The air hose connects to the compressor module to supply compressed air to the airbrush stylus. The control module regulates compressed air to the airbrush stylus. The method of applying cosmetics includes activating the control module, producing audiovisual prompts for loading cosmetics for a desired cosmetic application, producing audio visual instructions for applying cosmetics for the desired cosmetic application, and applying the cosmetics.

20 Claims, 2 Drawing Sheets

(51) Int. Cl.

| | |
|---|---|
| ***A45D 40/24*** | (2006.01) |
| ***A45D 7/00*** | (2006.01) |
| ***A45D 34/04*** | (2006.01) |
| ***A45D 44/00*** | (2006.01) |
| ***B05B 7/24*** | (2006.01) |
| *B05B 15/06* | (2006.01) |

(58) Field of Classification Search

USPC ..... 132/200, 212, 221, 271, 73, 73.5, 73.6, 132/317, 320, 333; 239/346, 340, 379, 239/341, 319, 353, 69; 434/100; 700/17, 700/83

See application file for complete search history.

(56) References Cited

U.S. PATENT DOCUMENTS

| | | | | |
|---|---|---|---|---|
| 5,156,684 | A * | 10/1992 | Mayer et al. | 118/301 |
| 6,067,996 | A * | 5/2000 | Weber et al. | 132/73 |
| 6,213,131 | B1 * | 4/2001 | Vien et al. | 132/285 |
| 6,267,297 | B1 * | 7/2001 | Contadini et al. | 239/1 |
| 6,286,517 | B1 * | 9/2001 | Weber et al. | 132/73 |
| 6,406,121 | B1 * | 6/2002 | Benjamin et al. | 347/20 |
| 6,757,074 | B2 * | 6/2004 | Schroeder | 358/1.3 |
| 6,758,423 | B1 * | 7/2004 | Perkins et al. | 239/690 |
| 6,937,755 | B2 | 8/2005 | Orpaz et al. | |
| 7,648,364 | B2 * | 1/2010 | Dauga et al. | 434/100 |
| 7,798,061 | B2 * | 9/2010 | Dilou | 101/127.1 |
| 7,950,925 | B2 | 5/2011 | McDaniel et al. | |
| 8,074,899 | B2 * | 12/2011 | Mehta | 239/346 |
| 8,118,509 | B2 * | 2/2012 | Marcellus | 401/188 R |
| 8,464,732 | B2 * | 6/2013 | Wong | 132/317 |
| 8,523,570 | B2 | 9/2013 | Mallick et al. | |
| 8,882,000 | B2 * | 11/2014 | Mehta | 239/346 |
| 2002/0196333 | A1 * | 12/2002 | Gorischek | 348/61 |
| 2004/0078278 | A1 | 4/2004 | Dauga et al. | |
| 2004/0110113 | A1 | 6/2004 | Huang et al. | |
| 2008/0245383 | A1 | 10/2008 | Tomandl | |
| 2009/0114236 | A1 * | 5/2009 | Mehta | 132/200 |
| 2010/0224210 | A1 * | 9/2010 | Rabe et al. | 132/221 |
| 2010/0252061 | A1 * | 10/2010 | Samain et al. | 132/200 |
| 2011/0124989 | A1 * | 5/2011 | Edgar et al. | 600/310 |
| 2011/0159463 | A1 | 6/2011 | Samain | |
| 2012/0158184 | A1 | 6/2012 | Ma et al. | |
| 2013/0068853 | A1 * | 3/2013 | Hsiao | 239/11 |
| 2013/0098382 | A1 | 4/2013 | Martin et al. | |
| 2013/0247929 | A1 * | 9/2013 | Namai | 132/200 |
| 2014/0318570 | A1 * | 10/2014 | Petry | 132/314 |

OTHER PUBLICATIONS http://tantalk.com/sunless/2374008-colormyst-airbrush-tanning-kit.html (May 20, 2008).*

* cited by examiner

SYSTEM AND METHOD FOR APPLYING COSMETICS

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to cosmetics. More particularly, the present invention relates to tools for applying cosmetics. The present invention also relates to the method of applying cosmetics using a particular tool. The tool of the present invention is an airbrush.

2. Description of Related Art including Information Disclosed under 37 CFR 1.97 and 37 CFR 1.98

Cosmetics enhance the physical appearance of the body. The terms "cosmetics", "make-up", and "makeup" are synonymous and refer to these substances used to change the way a person looks and smells. Cosmetics include powders, gels, emulsions, oils, and other compositions of various colors, consistencies, and scents. Arguably more importantly, cosmetics also affect the way the person feels. Cosmetics enhance beauty, affecting confidence and mood.

Various tools are used to apply cosmetics. Brushes, pads, lipsticks, and atomizers are common tools widely available to all users. Each individual has a preference for particular types of cosmetics and particular types of cosmetic applicators. Each individual has a comfort level with known cosmetics and cosmetic applicators set by experience and familiarity, such that desired looks are achieved with only those known cosmetics and cosmetic applicators. Learning a new cosmetic and learning to use a new cosmetic applicator takes significant time and risk. Training to use a new tool takes time and practice to acquire a level of skill. Professional makeup artists have the time to elevate their skills, but many home users do not have this time. Non-professionals still want adequate training to apply cosmetics. There is also the risk of looking bad and failing to enhance one's beauty, when trying new cosmetics and cosmetic applicators.

One type of cosmetic applicator is an airbrush. An airbrush is used to spray color onto a limited surface area using compressed air. The air brush can paint t-shirts and cars, but the air brush can also apply spray-on tanning and cosmetics. The user controls the amount of spray using a variable trigger to adjust the amount and speed of air passing through the brush. The skill of manipulating the fine control of this trigger increases the consistency and complexity of cosmetic application with the air brush. Air brush technique necessarily involves freehand skills. For instance, the air brush can blend colors and create soft edges without stencils. In the past, the air brush has been a cosmetic applicator for professional makeup artist due the special equipment and importance of skill and technique.

For new cosmetics and new cosmetic applicators, there is a need for proper training and instruction. For example, for the airbrush, the user will need to learn about the new cosmetics loaded into the airbrush and the visual effect of applying those new cosmetics. The user will also need to learn the technique for applying the cosmetics to create the desired visual appearance. Only the proper training and instruction will create the comfort level in the user, which encourages the user to continue using the new cosmetic applicator.

Various patents and publications are available in the field of applying cosmetics. United States Patent Publication No. 20020196333, published for Gorischek on Dec. 26, 2002, teaches a simple mirror and image display system. The system is a vanity console display with a mirror and a control unit. The control unit can be an interactive video screen or a touch screen integrated into the display with the mirror. A user can look in the mirror, while applying make-up, while receiving feedback and instructions from the control unit in the display. Variations include a camera input to upload the image of the face in the mirror to provide more particular instructions by the control unit.

United States Patent Publication No. 20080245383, published for Tomandl on Oct. 9, 2008, describes another basic model of integrated a control unit in a make-up system. The invention is a compact with a mirrored inner top lid and a containment unit for make-up in an inner bottom lid. The compact can be closed so as to protect the make-up while transporting. The invention further includes an audio or video or audio/video component housed inside the compact. When the compact is open, the component can be activated to provide audio instructions or video instructions or both, during application of the make-up. A user may look in the mirror and apply make-up, while listening to the audio script into the compact.

U.S. Pat. No. 7,950,925, issued to McDaniel et al. on May 31, 2011, for discloses a method for educating a consumer about a personal care product by accepting an input of physical characteristics data from the consumer and generating a visual 3D model of how a person with similar physiological characteristics would interact with the product. After the visual 3D model is generated, the consumer can interact with the model of the person and the personal care product for the purpose of visualizing how the product would work in practice.

United States Patent Publication No. 20120158184, published for Ma et al. on Jun. 21, 2012, discloses a combination of a makeup server expert system and a makeup robot. The system is designed to operate over a network, so that the makeup robot downloads or otherwise receives instructions from the server expert system. The server expert system may be manned by a cosmetic technician or the user may request a profile for the robot and simply download the profile without any real-time advice, from the server. The makeup robot comprises a nozzle, which sprays cosmetics on the user's face; a face distance measurer, which detects the dimensions of the user's face; and a computer system, which accepts or downloads profile instructions, applies them to the calculated facial dimensions, and sprays the appropriate levels of makeup onto the user's face.

United States Patent Publication No. 20130098382, published for Martin et al. on Apr. 25, 2013, discloses a motorized brush makeup kit. The kit includes a variable speed motor, rotating around its central axis, with multiple brush attachments each designed for a different type of makeup for use on a different part of the body. In one embodiment of the makeup kit, detailed instructions on how to use the kit may take the form of electronic materials, computer software, and/or videos. The method and kit helps teach a user to identify different portions of the body to apply makeup, and which brushes and/or motor speeds are appropriate, effectively teaching a user how to layer makeup around three identified zones of the face.

It is an object of the present invention to provide a system and method for applying cosmetics.

It is an object of the present invention to provide a system and method for applying cosmetics in a single integral unit It is an object of the present invention to provide a system and method for applying cosmetics in an interactive experience It is another object of the present invention to provide a system and method for applying cosmetics with an airbrush stylus.

It is another object of the present invention to provide a system and method for teaching the use of a cosmetic applicator.

It is still another object of the present invention to provide a system and method for teaching the use of an airbrush stylus.

It is yet another object of the present invention to provide a system and method for applying cosmetics in a positive and empowering experience.

It is an object of the present invention to provide a system and method for applying cosmetics with selected prompts and instructions for a desired cosmetic application.

It is an object of the present invention to provide a system and method for applying cosmetics tailored for individual user preferences.

These and other objects and advantages of the present invention will become apparent from a reading of the attached specification and claims.

SUMMARY OF THE INVENTION

Embodiments of the present invention related to a system and method for applying cosmetics. The system is an integral unit formed by a lower housing, an upper housing and cover. The integral unit is small, portable, compact, and stylish for a household appliance for use in personal grooming. A compressor module is contained in the lower housing, and a control module is contained in the upper housing. The lower housing has an outlet member near a bottom edge thereof, and the compressor module has a compressed air outlet in fluid connection with the outlet member. The upper housing covers the compressor module in the lower housing and is affixed to the lower housing around the rim of the housings. The upper housing can also include a mount on an exterior of the upper housing. In some embodiments, the mount is on a lateral side of the exterior of the upper housing.

The control module is comprised of a view screen, printed circuit board connected to the compressor module, an interactive control board connected to the printed circuit board, and a speaker. The upper housing is sandwiched between the compressor module and the control module. The cover fits over the control module in the upper housing and affixed to the upper housing around the rim of the upper housing. The activation and regulation of the compressor module is contained in the integral unit in a stylish package.

Embodiments of the present invention also include a cosmetics applicator in fluid connection with the compressor module through the outlet member. In one embodiment, the cosmetics applicator is comprised of an air hose and an airbrush stylus for the airbrushing cosmetics onto the face of the user. The air hose connects to the outlet member, so that the compressor module supplies compressed air to the airbrush stylus, and so that the control module regulates compressed air to the airbrush stylus. The regulation of the airbrush stylus allows for the proper application of cosmetics with compressed air.

The method of applying cosmetics with the system includes activating the control module; producing audiovisual prompts to the user; loading cosmetics into the air brush stylus, according to the audiovisual prompts related to a desired cosmetic application; producing audio visual instructions to the user; and applying cosmetics according to the audiovisual instructions related to the desired cosmetic application. The present invention teaches and instructs the user for performing in a single integral unit. The technique and advice to learn good technique is prompted and taught by the method of the present invention. In some embodiments, there are the steps of selecting the audiovisual prompts according to the desired cosmetic application. The system can be adjusted for any skin tone or pattern to instruct the user to achieve the desired look. When the system is connected to a computer network, the desired cosmetic application can be sent by the computer network to insure reliable and updated information on the technique.

The method also includes embodiments with audiovisual encouragements and user profiles. The user profiles allow for saving preferences for later repeated cosmetic applications and for securing marketing information for targeted advertisements and suggestions. For example, a prompt for a particular skin tone can be saved for reminder for the next time the product is purchased.

DETAILED DESCRIPTION OF THE DRAWINGS

Referring to FIGS. 1-4, the system 10 and method for applying cosmetics, according to embodiments of the present invention, are shown. The system 10 is a compact and stylish unit to provide an innovative experience in applying cosmetics. Beginner and home users are able to learn and to use a cosmetic applicator, that was previously only used by professional makeup artists. The system 10 allows regular beginner or home users to achieve the look and techniques of a professional makeup artist with interactive prompts, instruction, simulation, and encouragement. Every user can feel empowered to use a new cosmetic applicator and to apply cosmetics at an advanced level with confidence.

Figure 1:
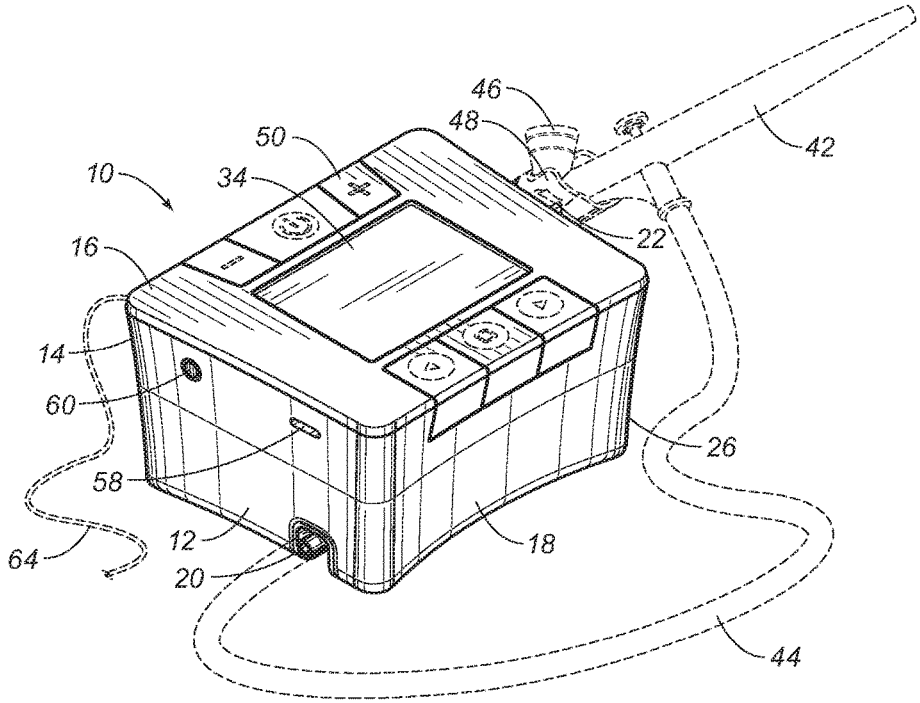
FIG. 1 is an upper perspective view an embodiment of the present invention, showing the system for applying cosmetics. The cosmetic applicator is an airbrush shown in broken lines. The power cord is also shown in broken lines.
Figure 2:
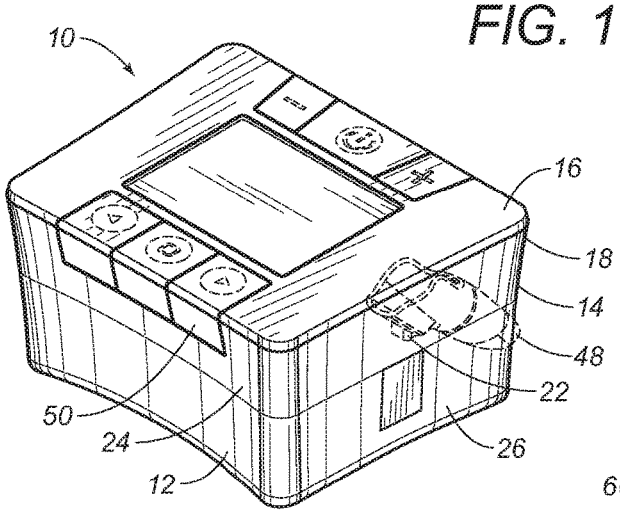
FIG. 2 is another perspective view of an embodiment of the present invention, showing a different side of the integral unit.
Figure 3:
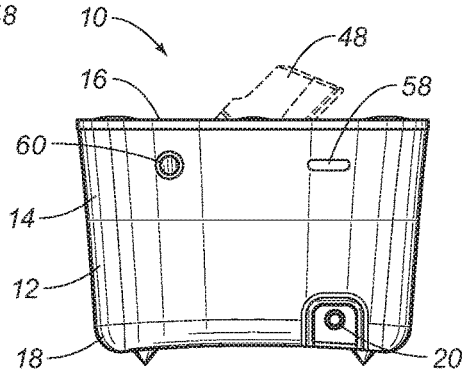
FIG. 3 is an elevation side view of an embodiment of the present invention.

FIGS. 1-3 show an embodiment of the system 10 with a lower housing 12, an upper housing 14, and a cover 16 to form an integral unit 18. The integral unit 18 has a compact size and stylish shape. Various colors and patterns can be used to enhance the aesthetic appeal of the system 10. The lower housing 12 has an outlet member 20 near a bottom edge. The upper housing 14 has a mount 22 on an exterior 24. In a particular embodiment, the mount 22 is on a lateral side 26 of the exterior. The cover 16 fits over the upper housing 14 to complete the integral unit 18. There are smooth surfaces and flush edges at the contact points between the lower housing 12, upper housing 14 and the cover 16. Generally, the rims of the housings 12 and 14 can be snap fit or otherwise sealed to each other. The rims connect to form interior volumes.

Figure 4:
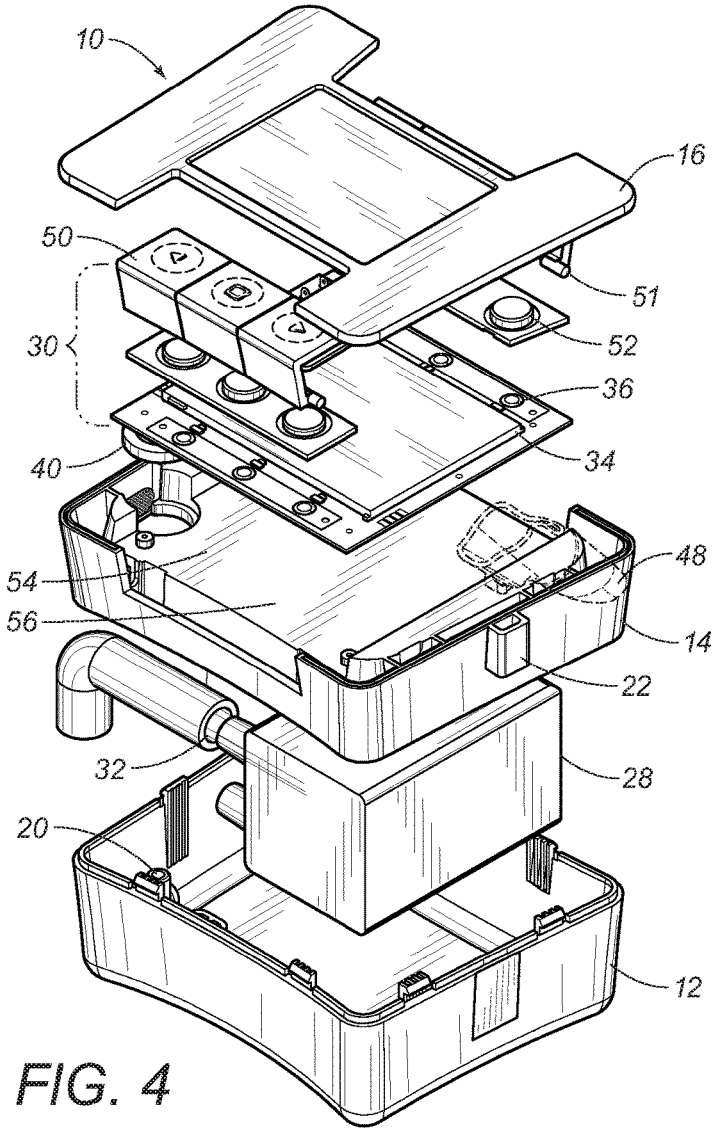
FIG. 4 is an exploded perspective view of an embodiment of the system for applying cosmetics according to the present invention.

Embodiments of the present invention also include a compressor module 28 contained in the lower housing 12, and a control module 30 in the upper housing 14. FIG. 4 shows an exploded view of the system 10. The compressor module 28 has a compressed air outlet 32 in fluid connection with the outlet member 20. The compressed air from the compressor module 28 is accessible via the outlet member 20. The upper housing 14 covers the compressor module 28 in the lower housing 12. The control module 30 is contained in the upper housing 14, on the top side, opposite the compressor module 28. The upper housing 14 is sandwiched between the compressor module 28 and the control module 30. In some embodiments, the control module 30 is comprised of a view screen 34, printed circuit board 36 connected to the compressor module 28, an interactive control board 38 connected to the printed circuit board 36, and a speaker 40.

For the present invention, FIG. 1 shows the system 10 also including a cosmetics applicator 42 in fluid connection with the compressor module 28 through the outlet member 20. In one embodiment, the cosmetics applicator 42 is comprised of an air hose 44 and an airbrush stylus 46. The airbrush stylus 46 can be loaded with a cosmetic, which channels compressed air to disperse the cosmetic onto the user. Using compressed air requires technique and training to insure the appropriate appearance of the make-up application. Previous professional equipment relied only upon the compressed air and the stylus, and the make-up artist would be responsible for the control and regulation of the compressed air. Also, compressors were not widely available for regular users. In the present invention, the air hose 44 connects to the outlet member 20, and the compressor module 28 supplies compressed air to the airbrush stylus 46. The control module 30 regulates compressed air to the airbrush stylus 46, and the user further controls the loading and dispersing from the airbrush stylus 46. When being stored, the airbrush stylus 46 can be placed on a stylus holder 48 in FIGS. 1, 2 and 4. The stylus holder 48 is removably attached to the mount 22 of the upper housing 14. In this arrangement, the system 10 incorporates the cosmetic applicator 42 in the same integral unit 18. There is less risk of losing or misplacing the separate parts required for the application of cosmetics.

Embodiments of the control module 30 include the view screen 34 being comprised of a liquid crystal display (LCD) or touchscreen. The view screen is interactive with the user, showing the status of the compressor and playing videos of step by step instructions and demonstrating the technique for a particular cosmetic application. The visual data is presented by the view screen 34, while the audio data is broadcast by the speaker 40. The speaker 40 is typically mounted in a top side 54 of the upper housing 14. The upper housing 14 can also have a chamber 56 for amplifying sound from the speaker 40. The chamber 56 allows for greater sound from a small speaker in a compact device. The single integral unit 18 enhances the combination of the compressor module 28 with the control module 30. The chamber 56 creates space in a generally rectangular shape on the upper housing 14, which can vibrate as an amplifier for the speaker 40. The speaker 40 is placed adjacent this chamber 56. The upper housing 14 may also include a screened speaker hole 58 on an exterior of the upper housing, as shown in FIG. 3. Sound emanates from the screened speaker hole 58, which corresponds to a location of the speaker 40 in the top side of the upper housing 14. The speaker 40 is located opposite the speaker hole 58 inside the upper housing 14.

Figure 5:
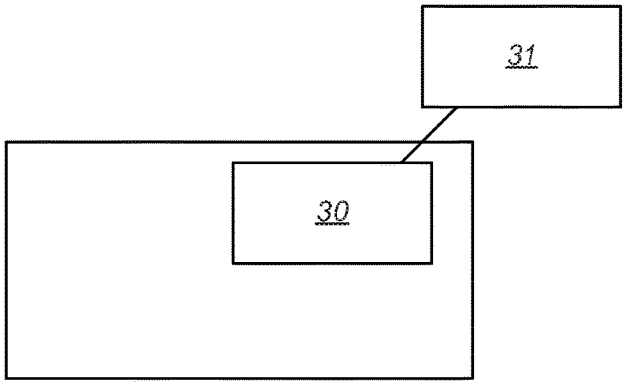
FIG. 5 is a block diagram illustration of an embodiment of the control module and computer network.

As the control module 30 is interactive, there can be an interactive control board 38 with a plurality of buttons 50 accessible through the cover 16. A user can press the buttons 50, while the cover 16 maintains the integral unit 18. The buttons 50 correspond to inputs 52 on the printed circuit board 36, such that pressing each of the plurality of buttons 50 corresponds to different activities of the compressor module 28. FIG. 4 shows the buttons 50 in the cover 16 with button presses 51 to engage the inputs 52. The interactive control board 38 can regulate speed and duration of activity of the compressor module 28. Faster or slower airspeed can be manually operated, giving the user complete control of the application of cosmetics. For example, the compressed air can start at a lower speed for beginners. Alternative embodiments include the view screen 34 as touchscreen, so that the buttons are on the view screen 34, not actual physical buttons. These "electronic" buttons would similarly relate to function of the compressor module 28. Those buttons would still input to the printed circuit board 36 to regulate the compressor module 28. In some embodiments, the control module 30 is connected to a wireless computer network 31, as shown in FIG. 5 so that the information presented on the view screen 34 or through the speaker 40 can be updated and changed. Special hints and instructions can be downloaded and presented through a wireless connection to the internet.

In another embodiment, the integral unit 18 includes a power inlet (not shown) and a power cord 64 for connecting to a power source, such as a wall outlet or other AC power source. FIG. 1 shows the power cord 64. The power cord 64 extends through a hole in the upper housing 14 on a side of the exterior separate from the screened speaker hole 58. The control module 30 regulates the power available to the compressor module 28 and components of the control module 30, such as the view screen 34 and printed circuit board 36. There can also be an activation switch 60, alternating between on and off positions, shown in FIG. 3. The activation switch 60 extends through a hole on a lateral side of the exterior of the upper housing 14 so that the system 10 can be turned on and off. In some embodiments, the activation switch 60 can have a default setting for an on position upon plugging in the power cord. The default setting automatically starts the control module and compressor module for easy and convenient use. There can also be a button on the interactive control board, corresponding to an activation function for control of the power through the interactive control board 38.

The present invention includes the method of applying cosmetics with the system 10. The first step is to activate the control module 30 by inserting a power cord 64 into a power source so as to set the control module 30 and the compressor module 28 into an on position, respectively. Power sources can include a wall socket or other AC power source, or another DC power source, such as a battery. In some embodiments, the control module 30 and the compressor module 28 are activated as on as soon as the power is supplied. Alternatively, there can be an activation switch 60, which requires the user to trigger the activation switch 60 in order to power the compressor module 28. The control module 30 can still be started automatically with the supply of power.

The next step is the production of audiovisual prompts on the view screen 34 and through sound from the speaker 40. Then, the cosmetics are loaded into the air brush stylus 46, according to the audiovisual prompts related to a desired cosmetic application. The desired cosmetic application can be selected on the control module 30, during the production the audiovisual prompts. The desired cosmetic application is the pattern and color of cosmetics to be applied to the user with the system 10. The skin tone, facial structure, and style of look desired by the user can be used to set the desired cosmetic application. The control module 30 has the interactive control board 38 to enter and process these elements of the desired cosmetic application. The audiovisual prompts are being selected as a result of the choosing and entering the characteristics of the desired cosmetic application. The broadcast of the audiovisual prompts can also be regulated by the control module 30, such as fast forwarding through video clips, rewinding audio instructions, and/or pausing through the audio and visual prompts.

After the cosmetics are loaded, the method includes producing audiovisual instructions on the view screen 34 and through sound from the speaker 40. The technique and order of application are provided to the user, so that the cosmetics are then applied according to the audiovisual instructions related to the desired cosmetic application. The audiovisual instructions can also be selected on the control module 30, according to the desired cosmetic application. The audiovisual instructions for certain facial structures and skin tones are different for other facial structures and skin tones. The level of expertise of the user can also be the basis for adjusting the audiovisual instructions. A first time beginner may require more instructions than a more experienced user. The experience level of the user can affect the selection of instructions produced by the system 10. To achieve a desired cosmetic application, the user receives individualized instructions according to the characteristics of the user. The interactive control board 38 or the view screen 34 as a touch screen can be used to navigate through the selections of either audiovisual prompts or audiovisual instructions. The broadcast of the audiovisual instructions can also be regulated by the control module 30, such as fast forwarding through video clips, rewinding audio instructions, and/or pausing through the audio and visual prompts.

The embodiments of the present invention include the control module 30 connecting to a wireless computer network. The memory in the control module 30 can be supplemented with new information and data from a computer network. The audiovisual prompts and audiovisual instructions are relayed from the wireless computer network as selected for the desired cosmetic application. The range and variety of prompts and instructions can be expanded with connection to a wireless computer network.

Alternative embodiments of the method of the present invention include the step of producing audiovisual encouragements during the step of applying cosmetics. The control module 30 is interactive, and additional audiovisual communication can be provided beyond prompts and instructions. Encouragements can further the positive experience of learning to use the airbrush stylus 46 and apply beautiful and stylish make-up.

To organize the prompts and instructions, there can be the step of storing preferences of past desired cosmetic applications. A user profile can be maintained on the control module 30 for storage on a computer network. The profile can include preferences, past prompts, past instructions, past desired cosmetic applications, and entered information about the user. Prompts and instructions can be selected easier for each application. Embodiments of the present invention further include generating audiovisual suggestions and linking additional services according to the prompts and instructions produced. The suggestions can enhance the experience of the desired cosmetic application by including new ideas. Those suggestions based on preferences and a user profile can further enhance the experience of using the system 10. Linking additional services on a wireless computer network can increase the utility of the system 10 as a marketing tool. Re-supplying cosmetics and associated products can be disclosed and offered to the user. Only relevant cosmetics and products are presented because the system 10 has access to the past prompts and instructions to narrow the types of products that a particular user will use.

Embodiments of the present invention disclose a system and method for applying cosmetics. The system has been made more accessible to non-professional users with various innovations in the combination and connection of modules. The single integral unit, for the additional structures to be coordinated with the compressor, enables the user to easily and conveniently apply cosmetics with consistency and good technique. The single unit is an innovative interactive experience with the control module and compressor module together. An advanced tool, such as the airbrush stylus, can be competently and effectively used by individuals, who may have previously been hesitant to use a new tool. Users lacking confidence and instruction would not purchase or use the airbrush stylus in the past. Currently, the embodiments of the present invention eliminate that lack of confidence and provide the necessary instructions. The system and method is personalized and prompts and instructions can be selected, according to personalized preferences, such as skill level and individual facial features. The preferences of the individual are incorporated into the system and method, unlike prior art technology in the field of cosmetic applicators.

The embodiments of the present invention also teach the use of a cosmetic applicator. Instead of printed instruction manuals and illustrations, the teaching component has become part of the applicator. In the example of the airbrush stylus, the teaching structures are always part of the cosmetic applicator. Once mastered or the user has sufficient confidence, the system can give encouragement, instead of teaching and repeating. The present invention provides this more interactive and personalized system to increase the use and positive experience of the user. The user is empowered and confident to use a new applicator, which was previously too daunting for non-professionals. Other prior art systems cannot achieve this sense of accomplishment and positive experience produced by embodiments of the interactive single unit of the present invention.

The foregoing disclosure and description of the invention is illustrative and explanatory thereof. Various changes in the details of the described system and method can be made without departing from the true spirit of the invention.

I claim:

1. A system for applying cosmetics, comprising:

a lower housing, having an outlet member near a bottom edge thereof;

a compressor module contained in said lower housing, said compressor module having a compressed air outlet in fluid connection with said outlet member;

an upper housing covering said compressor module in said lower housing and being affixed to said lower housing, said upper housing being comprised of a mount on an exterior of said upper housing;

a control module being comprised of a view screen, printed circuit board connected to said compressor module, an interactive control board connected to said printed circuit board, and a speaker, said control module being contained in said upper housing, said upper housing being between said compressor module and said control module;

a cover fitted over said control module in said upper housing and affixed to said upper housing, forming an integral unit of said lower housing, said upper housing and said cover; and a cosmetics applicator in fluid connection with said compressor module through said outlet member, wherein said cosmetics applicator is comprised of an air hose and an airbrush stylus, said air hose connected to said outlet member, wherein said compressor module supplies compressed air to said airbrush stylus, and wherein said control module regulates compressed air to said airbrush stylus.

2. The system for applying cosmetics of claim 1, wherein said mount is placed on a lateral side of said exterior.

3. The system for applying cosmetics of claim 1, further comprising a stylus holder, removably attached to said mount, said airbrush stylus being stored in said stylus holder.

4. The system for applying cosmetics of claim 1, wherein said view screen is comprised of at least one of a group consisting of a liquid crystal display screen and a touch screen.

5. The system for applying cosmetics of claim 1, wherein said interactive control board is comprised of a plurality of buttons corresponding to inputs on said printed circuit board, said plurality of buttons corresponding to activities of said compressor module.

6. The system for applying cosmetics of claim 1, wherein said interactive control board regulates speed and duration of activity of said compressor module.

7. The system for applying cosmetics of claim 1, wherein said control module is connected to a wireless computer network.

8. The system for applying cosmetics of claim 1, said speaker being mounted in a top side of said upper housing, said upper housing having a chamber amplifying sound from said speaker.

9. The system for applying cosmetics of claim 1, said upper housing have a screened speaker hole on an exterior of said upper housing, wherein sound emanates from said screened speaker hole, said screened speaker hole corresponding to a location of said speaker in said top side of said upper housing.

10. The system for applying cosmetics of claim 1, said control module further comprising an activation switch, alternating between on and off positions, said activation switch extending through a hole on a lateral side of said exterior of said upper housing.

11. The system for applying cosmetics of claim 10, said activation switch having a default setting for an on position upon plugging in said power cord.

12. A method of applying cosmetics with a system according to claim 1, the method comprising the steps of:

activating said control module by inserting a power cord into a power source so as to set said control module and said compressor module into an on position, respectively;

producing audiovisual prompts on said view screen and through sound from said speaker;

loading cosmetics into said air brush stylus, according to said audiovisual prompts related to a desired cosmetic application;

producing audio visual instructions on said view screen and through sound from said speaker; and applying cosmetics according to said audiovisual instructions, said audiovisual instructions related to said desired cosmetic application.

13. The method of applying cosmetics according to claim 12, further comprising the step of triggering an activation switch to set said control module and said compressor module into an on position.

14. The method of applying cosmetics according to claim 12, further comprising the steps of:

selecting audiovisual prompts using said interactive control board, according to said desired cosmetic application; and selecting audiovisual instructions using said interactive control board, according to said desired cosmetic application.

15. The method of applying cosmetics according to claim 14, said control module being connected to a wireless computer network, said audiovisual prompts being relayed from said wireless computer network as selected, said audiovisual instructions being relayed from said wireless computer network as selected.

16. The method of applying cosmetics according to claim 12, further comprising the step of producing audiovisual encouragements during the step of applying cosmetics.

17. The method of applying cosmetics according to claim 12, further comprising the step of storing preferences of past desired cosmetic applications.

18. The method of applying cosmetics according to claim 17, further comprising the step of generating audiovisual suggestions based on said preferences.

19. The method of applying cosmetics according to claim 17, further comprising the step of linking additional services via a wireless computer network according to said preferences.

20. The method of applying cosmetics according to claim 17, further comprising the step of maintaining a user profile based on said preferences and entered information.

* * * * *